US008312967B2

(12) United States Patent
Nielsen

(10) Patent No.: US 8,312,967 B2
(45) Date of Patent: Nov. 20, 2012

(54) ESCAPE SYSTEM WITH SELF-ADJUSTING LENGTH

(75) Inventor: Jens Nielsen, Arre (DK)

(73) Assignee: Viking Life-Saving Equipment A/S, Esbjerg V (DK)

( * ) Notice: Subject to any disclaimer, the term of this patent is extended or adjusted under 35 U.S.C. 154(b) by 527 days.

(21) Appl. No.: 12/444,132

(22) PCT Filed: Oct. 4, 2007

(86) PCT No.: PCT/DK2007/050136
§ 371 (c)(1),
(2), (4) Date: Oct. 15, 2009

(87) PCT Pub. No.: WO2008/040359
PCT Pub. Date: Apr. 10, 2008

(65) Prior Publication Data

US 2010/0051383 A1 Mar. 4, 2010

(30) Foreign Application Priority Data

Oct. 6, 2006 (DK) ..... 200601300
Oct. 4, 2007 (WO) ..... PCT/DK2007/050136

(51) Int. Cl.
*A62B 1/20* (2006.01)

(52) U.S. Cl. ..... 182/48

(58) Field of Classification Search ..... 182/48
See application file for complete search history.

(56) References Cited

U.S. PATENT DOCUMENTS 3,973,644 A 8/1976 Zephinie
4,099,595 A * 7/1978 Tracy ..... 182/48
5,765,500 A 6/1998 Nordbe
6,102,762 A * 8/2000 Bell et al. ..... 441/80

FOREIGN PATENT DOCUMENTS

CA 2 161 764 10/1995

(Continued)

OTHER PUBLICATIONS

International Preliminary Report on Patentablility/Written Opinion corresponding to International App. No. PCT/DK2007/050136, Intl. Bureau of WIPO, dated Apr. 7, 2009, 6 pages.

(Continued)

*Primary Examiner* — Alvin Chin Shue
(74) *Attorney, Agent, or Firm* — Wood, Herron & Evans, LLP

(57) ABSTRACT

An escape system (1) for evacuation is disclosed including a chute (2) comprising a succession of linked and spaced apart shaping sections (7), the succession including a number of shaping sections being connected by elastic cords (9) and linking successive shaping sections in a direction corresponding to a longitudinal axis (18) of the succession of shaping sections, and at least one tunnel-like device (6) being adapted to enable a person (16) who is being evacuated to move from a first position (3) to a second position (4) through the tunnel-like device, and wherein the chute (2) is arranged to have a self adjusting length (20, 22) and hereby operable at least two relative different chute lengths (20, 22) when the chute (2) has been launched and the chute is hanging substantially vertically from the higher position to the lower position, and the escape system comprises length limiting means (32, 36, 38) for changing between operation modes (24, 26) between the at least two relative different chute lengths (20, 22).

19 Claims, 7 Drawing Sheets

FOREIGN PATENT DOCUMENTS

| | | | |
|---|---|---|---|
| GB | 2 291 845 | A | 7/1996 |
| GB | 2 338 219 | A | 12/1999 |
| NO | 84/02658 | | 7/1984 |

OTHER PUBLICATIONS

European Patent Office, International Search Report dated Nov. 28, 2007.

* cited by examiner

ESCAPE SYSTEM WITH SELF-ADJUSTING LENGTH

FIELD OF THE INVENTION

The present invention relates to an escape system for emergency evacuation from a first higher position to a second lower position.

BACKGROUND OF THE INVENTION

Various solutions have been presented in the past for evacuating people from buildings, airplanes, ships and oil rigs. When the height is given and constant, one set of conditions are given, but when the height varies the problems become more difficult. Varying height is especially present under maritime emergency conditions, e.g. due to high waves and/or because a ship has a list, i.e. is tilting to one side because of a displaced cargo or due to a hole in one side where water is flooding in. Maritime emergencies often happen during stormy weather which is a factor that increases the problem of varying height. In one known solution there is a slide which extends from the high evacuation point and downwards in a 30-45 degree angle away from the ship to the sea.

The company VIKING LIFE-SAVING EQUIPMENT of Esbjerg, Denmark, has marketed maritime systems adapted for evacuation where most of the descent is practically vertical. Such systems comprise a chute having a succession of linked, rigid and spaced apart steel rings which are connected by elastic cords attached to the rings. The elastic cords and rings are arranged to allow longitudinal stretching as well as contraction. The chute also has an elastic tunnel-like device arranged and held inside the succession of rings. The tunnel-like device is adapted to slow a rate of descent of a falling person who is being evacuated through the tunnel-like device. Each elastic cord extends vertically from the top to the bottom of the chute when the chute is in use and is launched from a high evacuation position and allowed to extend freely downwards. The long elastic cords are attached to each ring with a bracket and extend in parallel, vertical courses of direction, each being parallel to a longitudinal axis of the chute. Normally the lower end of the chute is anchored at a floating platform or life raft. Due to the elastic cords, the chute is able to stretch as well as contract to compensate for varying height caused by waves. This allows people to escape through the chute even when the length of the chute changes.

Escape or rescue devices are also known from WO 84/02658 and U.S. Pat. No. 3,973,644. WO 84/02658 discloses a tunnel-like escape device comprising a stocking of canvas material or similar material. The stocking, which is made of netting permitting the passage of wind, is with axial intervals provided with an annular reinforcing element for stretching out the stocking. The stocking is connected to two or more axially extending lines which are connected to the reinforcing elements and to each reinforcing element on diametrically opposite sides thereof. However, since rigid lines are used to connect the reinforcing elements, such a device is unsuitable for use where the vertical escape height is varying. U.S. Pat. No. 3,973,644 discloses a rescue apparatus for enabling persons to escape safely from burning buildings, for instance, and comprises a flexible tubular device which is elastic only in the transverse and circumferential direction to slow the rate of descent of a body falling through the tubular device, various means being provided for fixing the open upper end of the tubular device to the elevated point when the person is to be rescued through the lower open end of the device. Furthermore, such an apparatus is unsuitable for compensating for varying height.

Over the years it seems that storms are becoming harsher. Also, ships and liners are becoming larger and larger. This combination calls for an improvement of escape systems in order to increase safety in such conditions.

SUMMARY

It is an object of the present invention to provide an escape system which allows substantially vertical evacuation and which provide improved compensation for varying and relative different evacuation heights. Other objects appear from the description and the appended figures.

One aspect of the invention involves an escape system for emergency evacuation from a first higher position to a second lower position, said escape system including a chute, said chute comprising:

- a succession of linked and spaced apart shaping sections, said shaping sections each having at least one ring-like structure, said succession including a number of shaping sections being connected by elastic cords attached to the shaping sections in positions along circumferences of the ring-like structures, said elastic cords linking successive shaping sections and being arranged to allow relative motion substantially in a direction corresponding to a longitudinal axis of the succession of shaping sections, and
- at least one tunnel-like device arranged and held inside the succession of shaping sections, said tunnel-like device being adapted to enable a person who is being evacuated to move from said first position to said second position through the tunnel-like device, and wherein the chute is arranged to have a self adjusting length and hereby operable at at least two relative different chute lengths when the chute has been launched and the chute is hanging substantially vertically from the higher position to the lower position, and the escape system comprises length limiting means for changing between operation modes between the at least two relative different chute lengths.

Improved compensation for varying and different evacuation height could be obtained by using elastic cords allowing higher strain and thereby longer elongation. Higher strain means higher stress, which indicate risk of rupture and is therefore not considered. A longer chute may allow longer maximum length, but on the other hand also longer minimum length, and hence is not a solution. By the present invention it is realised that a longer elongation of the chute may be obtained without increasing the minimum length when the chute is arranged to have a self adjusting length and hereby operable at at least two relative different chute lengths when the chute has been launched and the chute is hanging substantially vertically from the higher position to the lower position, and the escape system comprises length limiting means for changing between operation modes between the at least two relative different chute lengths. A possible advantage hereby is that an escape system is provided which is useable when the distance between the first higher position and the second lower position is unknown upon launch of the escape system and which system can both adapt its length to smaller variations in the distance, such as waves and people being evacuated within the chute and hereby at least effecting the spacing between shaping sections, as well as larger differences in a necessary chute length e.g. due to a list of a ship and similar escape systems being provided on both sides of the ship.

When the length limiting means in a first mode of operation is engaged and limiting the chute from prolongation beyond a certain distance when the chute has been launched and the chute is hanging substantially vertically from the higher position to the lower position and wherein the length limiting means in the second mode of operation is disengaged and not limiting the chute from prolongation beyond the certain distance when the chute has been launched and the chute is hanging substantially vertically from the higher position to the lower position, a possible advantage is that an escape system is provided which in a controlled way is extendable to relative different levels of an extension length at least in the longitudinal direction.

When an obtainable spacing between two or more shaping sections in a mode of operation is limited to a predetermined extend at least in a direction of the longitudinal axis by engagement of the length limiting means, and an obtainable spacing between two or more shaping sections in a mode of operation is increased to a predetermined extend at least in a direction of the longitudinal axis by disengagement of the length limiting means, a possible advantage is that an escape system is provided which in a controlled way is extendable to relative different levels of an extension length at least in the longitudinal direction is provided. It follows that the escape system according to the invention may also provide an increased overall chute length not only in the longitudinal direction in a situation where this is helpful.

When an escape system wherein the connection of the succession of shaping sections includes a number of elastic cords where at least part of the elastic cords are at least partly limited from being prolonged in a first mode of operation by engagement of the length limiting means, and a number of elastic cords wherein at least part of the elastic cords are not at least partly limited from being prolonged in a second mode of operation by disengagement of the length limiting means, and wherein changing between the modes of operation provides a change of the length of the chute, a preferred embodiment of a construction to increase the chute length in a controlled way is provided. It is to be understood that a chute which is unnecessarily long or unnecessarily elastic as well as a chute which is to short or to non-elastic provides a risk for not being appropriate for evacuation. As an example an unnecessarily long chute may cause people to get stock within the chute due to the chute not extending primarily in the longitudinal direction. Therefore a controlled change of the mode of operation of one or more connections between shaping section is advantageous when having to adapt the overall chute length.

Therefore, the mode of operation is preferably provided after launch of the escape system and the chute is hanging vertically from the first higher position to the second lower position by a continued engagement of one or more of the limiting means or by a disengagement of one or more of the length limiting means.

The direction of prolongation of the elastic cords which are at least partly prevented from prolonging in the first mode of operation may, at least in a situation when the elastic cords are not limited by the length limiting means, be prolonging or progressing in the longitudinal vertical direction only or may only partly be prolonging or progressing in the longitudinal vertical direction or may primarily be prolonging or progressing in a direction different from vertically.

When the elastic cords include cords which are extending between successive shaping sections in a course of direction which is progressing differently from vertically when the chute has been launched and the chute is hanging vertically from the higher position to the lower position, a possible advantage may be that the extent of the cords between the shaping sections is thereby longer without the distance between the shaping sections becoming longer. Since any elastic cord has a maximum strain which it may safely endure, a longer extent of such a cord subjected to maximum strain will result in a longer elongation, and hence longer maximum length while maintaining or even reducing minimum length. One effect is therefore that the ability of the escape system to compensate at least for varying evacuation height is improved.

When elastic cords are included which at least are connected two-by-two providing a coupling between the at least two elastic cords, a possible advantage is that the coupling between the cords provides a suitable connection point for the length limiting means to be connected to. The coupling could be provided with a connector, and the connector could be a resilient connector or it could be a lashing or another rigid connector. Still further the elastic cords could be connected without a connector, such as be twisted around each other.

When the length limiting means comprises a substantially non-prolongable connection which is engaged between a shaping section and the coupling in a first mode of operation, and the connection provides a spacing in a direction of the vertical axis between the shaping section and the coupling which is limited while the length limiting means are engaged compared to when the length limiting means are not engaged and the substantially non-prolongable connection is not engaged in a second mode of operation, a possible advantage may be that a part of the elasticity and a part of obtainable length of the chute or a section of the chute is limited and hereby the length and the elasticity of the chute is controlled.

Other embodiments of where to provide a releaseable or disengageable substantially non-prolongable connection in the chute in order to provide parts of the system which may be released or disengaged for increasing the chute length is provided in the drawings and claims.

When the connection of the succession of shaping sections includes a number of elastic cords which are at least partly limited from substantially extending in a direction of the longitudinal axis in one mode of operation by engagement of the length limiting means, and wherein the connection of the succession of shaping sections includes a number of elastic cords which are not at least partly limited from substantially extending in a direction of the longitudinal axis in an other mode of operation by disengagement of the length limiting means, a possible advantage may be that another or additional way of increasing the chute length is provided. This way of increasing the chute length may be the sole way to increase the length or it may be followed by or it may follow a release of a number of elastic cords which has been at least partly prevented in prolonging. Therefore the other mode may be the second mode or a third mode or the other mode described here may be the second mode to be followed by a number of elastic cords where at least part of the elastic cords are disengaged from a prolongation. Numerous ways to provide elastic cords which are have a progression in a direction not in a direction of the vertical direction which can be released in one or more steps in order to increase the system length can be chosen. One such way is to provide a number of elastic cords where the elastic cords include cords which are extending between successive shaping sections in a course of direction which is progressing differently from vertically when the chute has been launched and the chute is hanging vertically from the higher position to the lower position, and wherein elastic cords are included which at least are connected two-by-two with a lashing or a rigid connector, said connector providing a coupling between the at least two elastic cords, preferably substantially midway between two shaping sections in one mode of operation, and wherein the resilient connection, the lashing or the rigid connector is disengaged in an other mode of operation.

Embodiments of the length limiting means, means to trigger the disengagement means comprised in the length limiting means such as trigger lines to trigger a disengagement of the length limiting means, connections of the trigger lines to different parts of the escape system and lengths of the trigger lines are given herein.

Furthermore, as an alternative to providing a construction with e.g. trigger lines and slip hooks an escape system with a self-adjusting length can comprise length limiting means which in a controlled way disengage themselves when subject to a certain strain. These means may be means such as a strip of a synthetic material applied and connected between parts, which parts hereby has a fixed distance between them in a first mode of operation, and which strips breaks when subject to a certain strain and hereby provides a second mode of operation with an increased chute length.

A further embodiment of the invention involves that the chute includes a plurality of parallel and connected chute sections, each chute section being adapted to allow escape from the higher position to the lower position. This may include that the chute is a twin, triple or quadruple chute. In case of a twin-chute, such a chute may include two stocking-like devices, and the shaping sections have two connected ring-like structures, preferably being shaped and arranged in a figure-of-eight-like manner. Such a twin-chute may double the evacuation capacity of the system, since two persons may simultaneously escape via each of the two stocking-like devices. Also, multiple or plural chute sections provide redundancy such that in case one chute section becomes blocked or fails, then other chute sections may still be functioning, whereby safety is increased. Preferably the system is adapted for maritime use and includes at least one rescue vessel, survival craft, life raft or a platform, which is adapted for being positioned floating at the second lower position. This may involve that the system is adapted for being launched from a sailing vessel, preferably a passenger liner, a ferry, a cargo vessel or a cruise liner, or an oil rig.

DETAILED DESCRIPTION OF THE FIGURES

The figures show simplified, exemplary features and functionalities of an escape system according to the invention. The figures are merely included as information given as examples to a skilled person of how the invention may be carried out.

Figure 1:
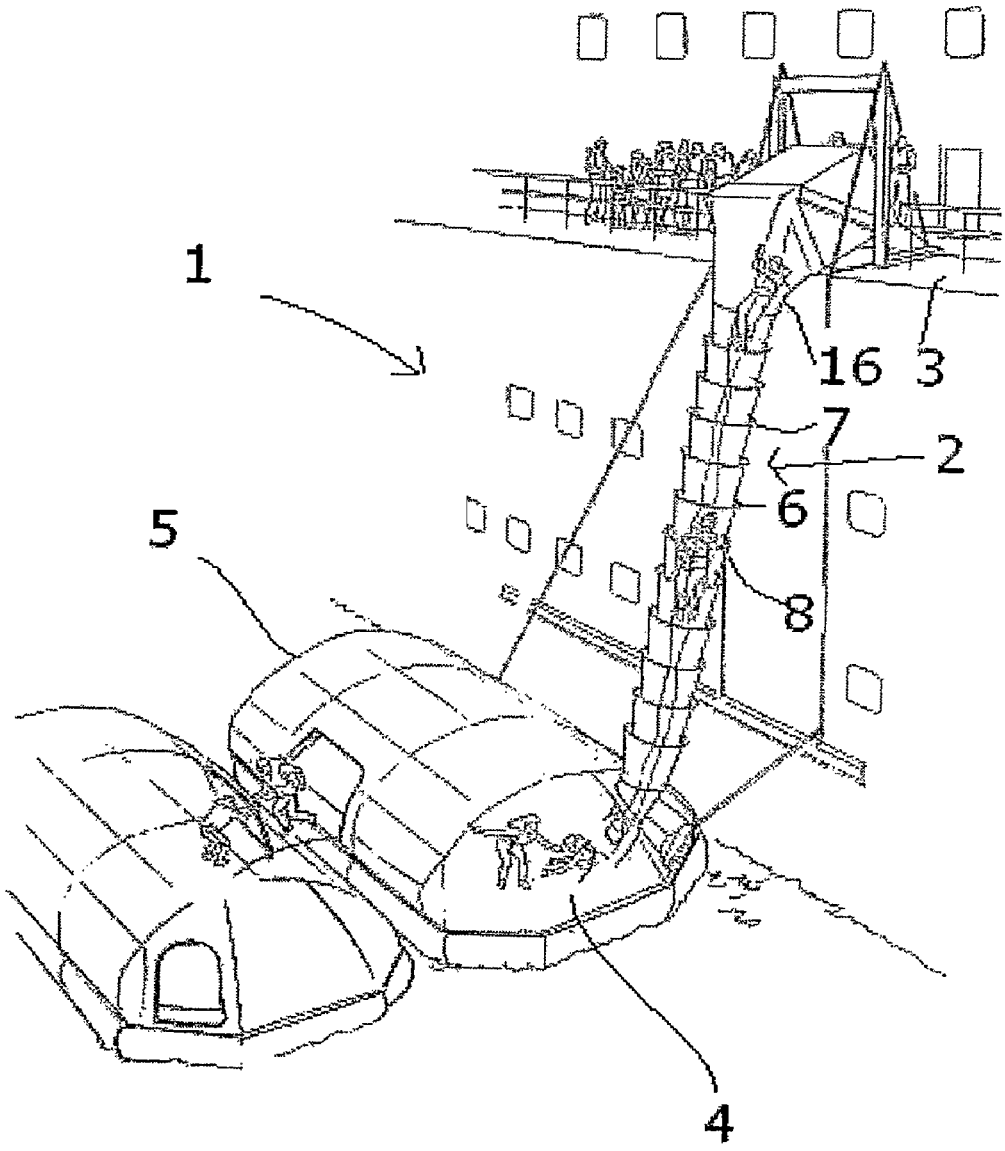
FIG. 1 shows a perspective view of an escape system according to the invention in use under maritime conditions, where people are evacuated from a passenger liner to a floating platform.

FIG. 1 shows an escape system 1 according to the invention. The system 1 has been launched from a passenger liner for emergency evacuation from a first higher position 3 to a second lower position 4 where a floating platform 5 is placed. The escape system 1 includes a chute 2 adapted to compensate for varying vertical distance between the first higher and the second lower positions 3, 4. The chute 2 is preferably anchored to the floating platform 5. The chute 2 has a succession of linked, rigid and spaced apart shaping sections 7. The shaping sections each have a ring-like structure which may be circular or C-shaped, but may also be oval, triangular, rectangular, polygonal or any shape which forms a type of enclosure and which is smooth and rounded with no sharp corners. The shaping sections 7 are connected by elastic cords (not shown) which are attached to circumference of the shaping sections 7 for linking the successive shaping sections 7 in a way which allows relative motion substantially in a direction corresponding to a longitudinal axis of the succession of shaping sections 7. The longitudinal axis of the succession of shaping sections 7 corresponds to a longitudinal axis of the chute 2. An elastic tunnel-like device 6 is arranged and held inside the succession of shaping sections 7. The tunnel-like device 6 is adapted to slow a rate of descent of a falling person who is being evacuated from the first higher position 3 to the second lower position 4 through the tunnel-like device 6. In stead of the tunnel-like device other devices may be used, which may aid a person to descent safely inside the chute 2. At the upper end of the chute 2 is a person 16 entering the tunnel-like device 6 in order to slide downwards through the tunnel-like device 6 to the floating platform 5. To protect and guide the tunnel-like device 6 there is provided a number of funnels 8, each of which are attached to a shaping section 7 in one end.

Figure 2:
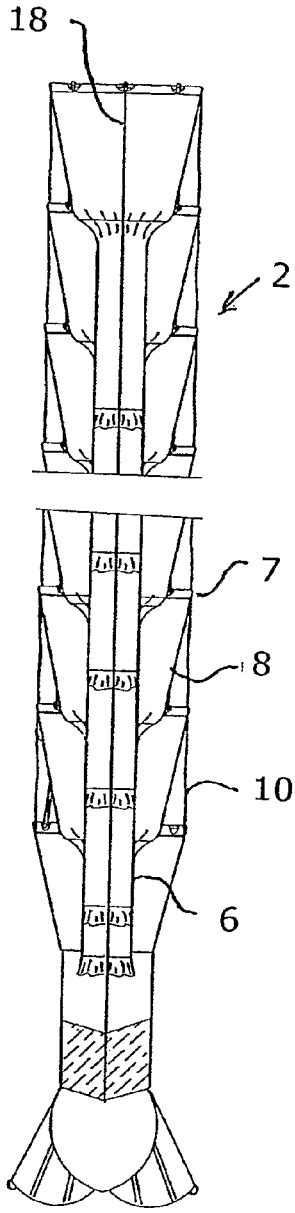
FIG. 2 shows a longitudinal, cross-sectional view of a chute.

FIG. 2 shows a chute 2 including a succession of shaping sections 7 having funnels 8 extending inwards conically to guide a tunnel-like device 6 made from a number of successive tunnel-like sections which are each placed and held inside the shaping sections 7. The tunnel-like device 6 may be manufactured using a non-abrasive Kevlar™ net or fabric. In one embodiment the tunnel-like device 6 is attached to each shaping section 7. The funnels 8 may be made of a woven or a non-woven textile. A longitudinal axis 18 of the succession of shaping sections is shown. The longitudinal axis 18 corresponds to a longitudinal axis of the chute 2. The chute 2 may externally be provided with a chute protector 10, such as an elastic, tubular tarpaulin as displayed in FIG. 2. The chute protector 10 may alternatively be made from a knitted jersey fabric. In order to facilitate entry into the tunnel-like device 6, a plastic lining, e.g. made of polyvinyl chloride (PVC), may be provided at the entrance.

Figure 3:
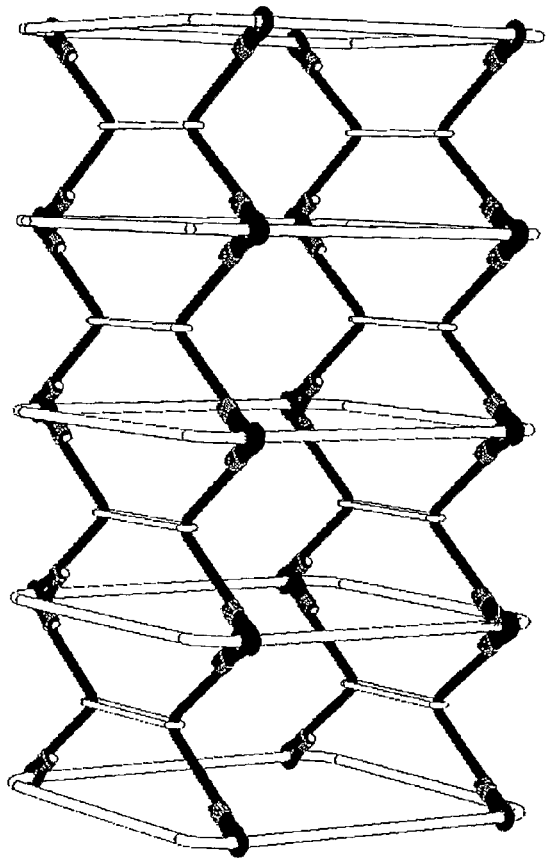
FIG. 3 shows a perspective view of shaping sections linked with elastic cords.

FIG. 3 show shaping sections 7 connected by elastic cords 9. The elastic cords 9 are in pairs two-by-two connected in a coupling by a resilient connector 12. In stead of the resilient connector 12 the elastic cords may be fixed to each other by a lashing, bracket or by another rigid connector.

The depicted shaping sections 7 are generally rectangular in shape with rounded corners. The shape of the ring-like shaping sections 7 may be round or triangular, rectangular or polygonal with rounded corners, or oval, and has a minimum diameter or transversal size of 0.7 meters. The longitudinal axis 18 which corresponds to the one shown in FIG. 2, but which is not shown in FIG. 3, extends longitudinally to the succession of four shaping sections 7. A first plane containing two connected elastic cords 9 is parallel to the longitudinal axis of the succession of shaping sections 7, but in a second plane which is perpendicular to such a first plane, and which is parallel to the longitudinal axis, the cords 9 extend in a course of direction progressing differently from a linear course of direction which is parallel to the longitudinal axis of the succession of shaping sections 7.

The primary object is to lead the cords 9 in courses of directions which substantially longer than a straight, linear vertical path. This is in a situation such as in FIG. 3 which corresponds to when the escape system 1 has been launched and the chute 2 is hanging from the higher position 3 to the lower position 4, such that tension is applied to the elastic cords 9 as displayed in FIG. 1. The elastic cords 9 are individual sections which each link two shaping sections 7 and are attached to the shaping sections 7 by a lashing 14. Four cords 9 link two successive shaping sections 7, but also six, eight or more elastic cords may be used for linking two successive shaping sections 7. The elastic cords 9 may of course instead be arranged in individual cord sections which each are connecting multiple, successive shaping sections 7. In such case the cords 9 may be connected to the shaping sections 7 by lashings 14 and/or brackets. The elastic cords 9 preferably have an elasticity where a force in the range from 100 to 600 N is required to obtain a 50% strain, which means that it takes 100 to 600 N to stretch a cord with an unstretched length of 1.0 meter to a length of 1.5 meters. The shaping sections 7 are preferably rings made of metal, preferably stainless steel, or a polymeric material, wood, or a composite material containing fibres. The shaping sections 7 may have ring-like shapes and are preferably substantially rigid. In FIGS. 2 and 3 the successive shaping sections 7 are connected with elastic cords 9 having substantially equal lengths. When manufactured the shaping sections 7 are connected to elastic cords 9 at substantially equal distances. The chute 2 may also have successive shaping sections 7, which are connected with elastic cords having dissimilar length in the succession of shaping sections 7, preferably having a shorter length near the first higher position 3.

Figure 4A:
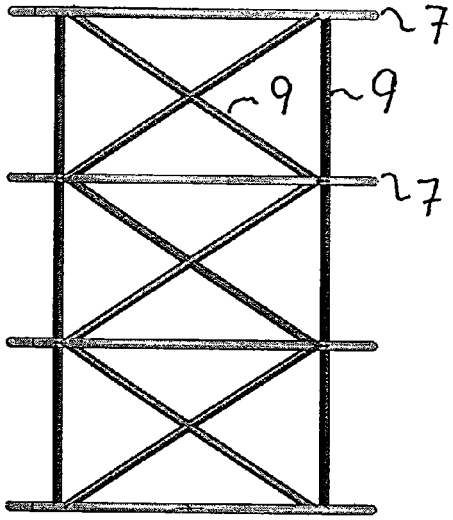
FIGS. 4*a* & 4*b* show views of shaping sections linked with elastic cords: crossed two-by-two.
Figure 4B:
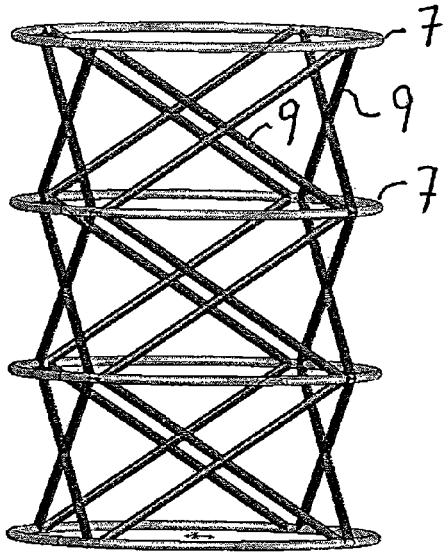

FIGS. 4*a* and 4*b* show a succession of four shaping sections 7 connected by elastic cords 9. The shaping sections are round. Eight cords connect two successive shaping sections 7 where the cords 9 two-by-two cross each other, whereby the cords 9 are longer than if the cords 9 were arranged in a straight course of direction from section 7 to section 7, which would be a linear course parallel to the longitudinal axis of the succession of shaping sections 7.

Figure 5:
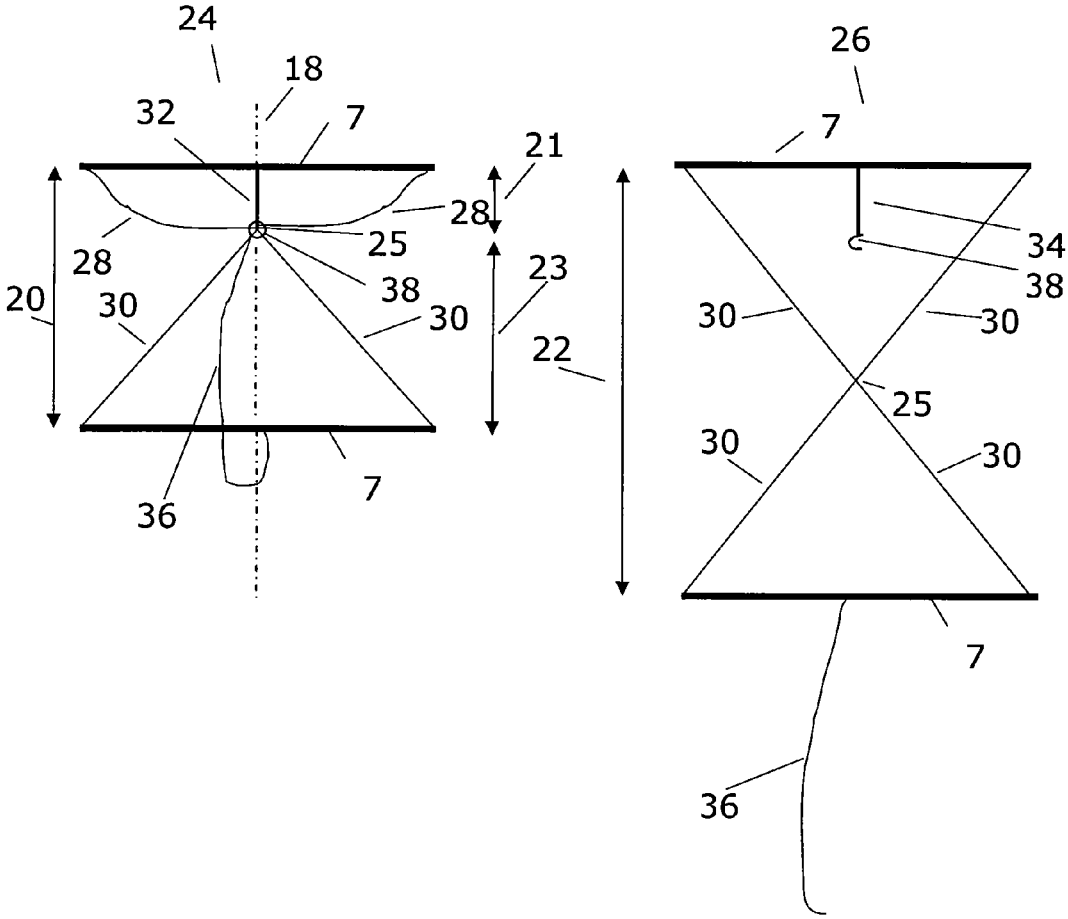
FIGS. 5-8 show examples of how at least part of the elastic cords are at least partly limited from being prolonged in a first mode of operation, and how at least part of the elastic cords are not at least partly limited from being prolonged in a second mode of operation.

FIG. 5 shows a view according to the viewpoint shown in FIG. 4*a*. In this example no elastic cords are shown on a left and a right side of the part of the chute shown. Furthermore the elastic cords on a backside of the chute are not shown. However, is to be understood that an arrangement according to the examples shown herein may be present on two or four sides of the chute. Furthermore, it is to be understood that between some shaping sections 7 an arrangement with one construction and function may be present, preferably with the same construction and function on the two or four sides, whereas another construction may be present between other shaping sections.

On the left side of FIG. 5 a chute with two shaping sections 7 (which normally is only a part of the chute) is shown in a first mode of operation 24. In the first mode the chute length can be varying around a first chute length 20. Variation of the chute length is provided by the parts 30 of the elastic cords not being limited in prolonging.

The parts 28 of the elastic cords are limited from being prolonged in the first mode of operation by engagement of the length limiting means, which in this example is an engaged substantially non-prolongable connection 32 which is engaged with or attached to the coupling 25 by an engagement/disengagement means 38 and which non-prolongable connection is attached to the shaping section 7. In this example the coupling 25 is a lashing. Furthermore the part 28 along with the part 30 is one elastic cord. This applies for the cords in both left and right side of the chute.

A trigger line 36 is shown connected to the engagement/disengagement means 38, in this example a slip hook 38, and to the shaping section 7. When the elastic cord parts 30 prolongs so that a length 23 of an elastic part of the connection between the shaping sections is equal to or larger than a length of the trigger line 36, the slip hook 38 is disengaged and a change to a second mode of operation 26 is provided.

The elastic part of the connection between the shaping sections include the elastic parts 30 in the first mode, whereas the cord parts 28 is a non-elastic or non-active part of the connection between the shaping sections in the first mode. Preferably the chute comprises one or more active sections between each non-active section.

The second mode of operation 26 is shown on the right side of FIG. 5. In the second mode of operation the substantially non-prolongable connection is not engaged 34 and the slip hook 38 has been opened. Thus in the second mode of operation the parts 28 of the elastic cords which were prevented from prolonging in the first mode of operation 24 is now no-longer prevented from or limited in prolonging by the substantially non-prolongable connection 32, in contrast, the sunstantially non-prolongable connection is now not engaged 34. In the second mode of operation the chute compensates from variations in the distance between the first higher position and the second lower position at or around a second chute length 22. The first and the second chute lengths 20 and 22 are relative different and normally a difference between the lengths is larger than the obtainable variations in the length 20 of the chute due to e.g. a varying prolongation of the cords 30 shown in the first mode of operation in FIG. 5.

The trigger line may e.g. be provided with a length to trigger the slip hook when a strain in the cords 30 in the first mode of operation is beyond a predetermined level. As an example of such predetermined level when the strain is equal to or more than 50% of a maximum allowable strain, or when the strain is more than 75% or as an example when the strain reaches 90% of a maximum allowable strain.

A length 21 of the non-prolongable connection 32 and hereby a length of the non-elastic part of the connection between the shaping sections can be chosen. As an example hereof the slip hook 38 may be the sole non-prolongable connection between the shaping section and the coupling 25.

Figure 6:
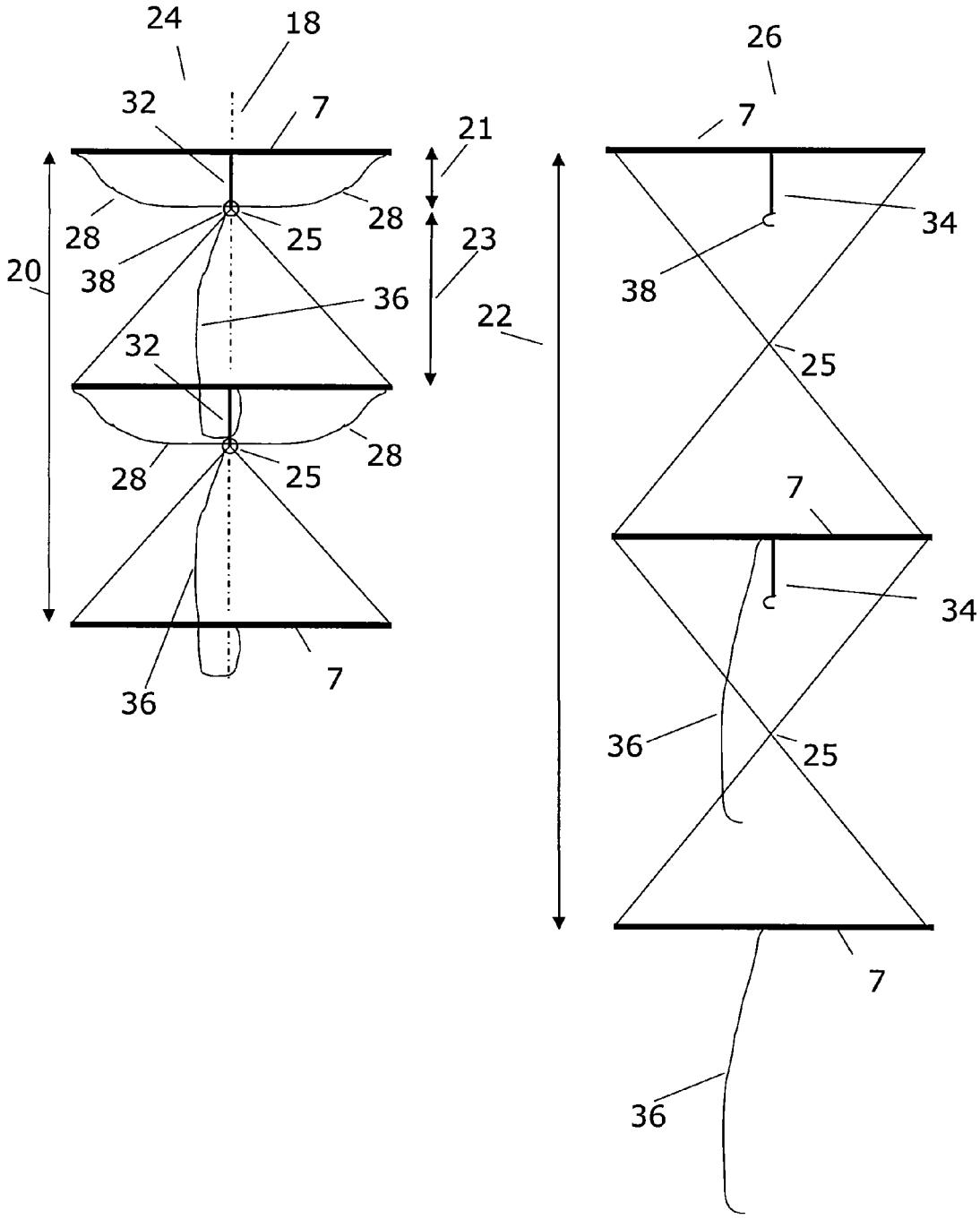

FIG. 6 shows an example in accordance with the invention were a connection between three shaping sections 7 is changed from a first mode of operation 24 to a second mode of operation 26. The construction of the arrangement between two successive shaping sections is as described for FIG. 5. Preferably but not necessarily the two triggering lines 36 as described under FIG. 5 triggers the slip hook 38 at one moment of time and provides the chute length 22 in the second mode of operation, hereby providing a chute with a self adjusting length which adjust it self from the first length 20 to the second length 22.

Figure 7:
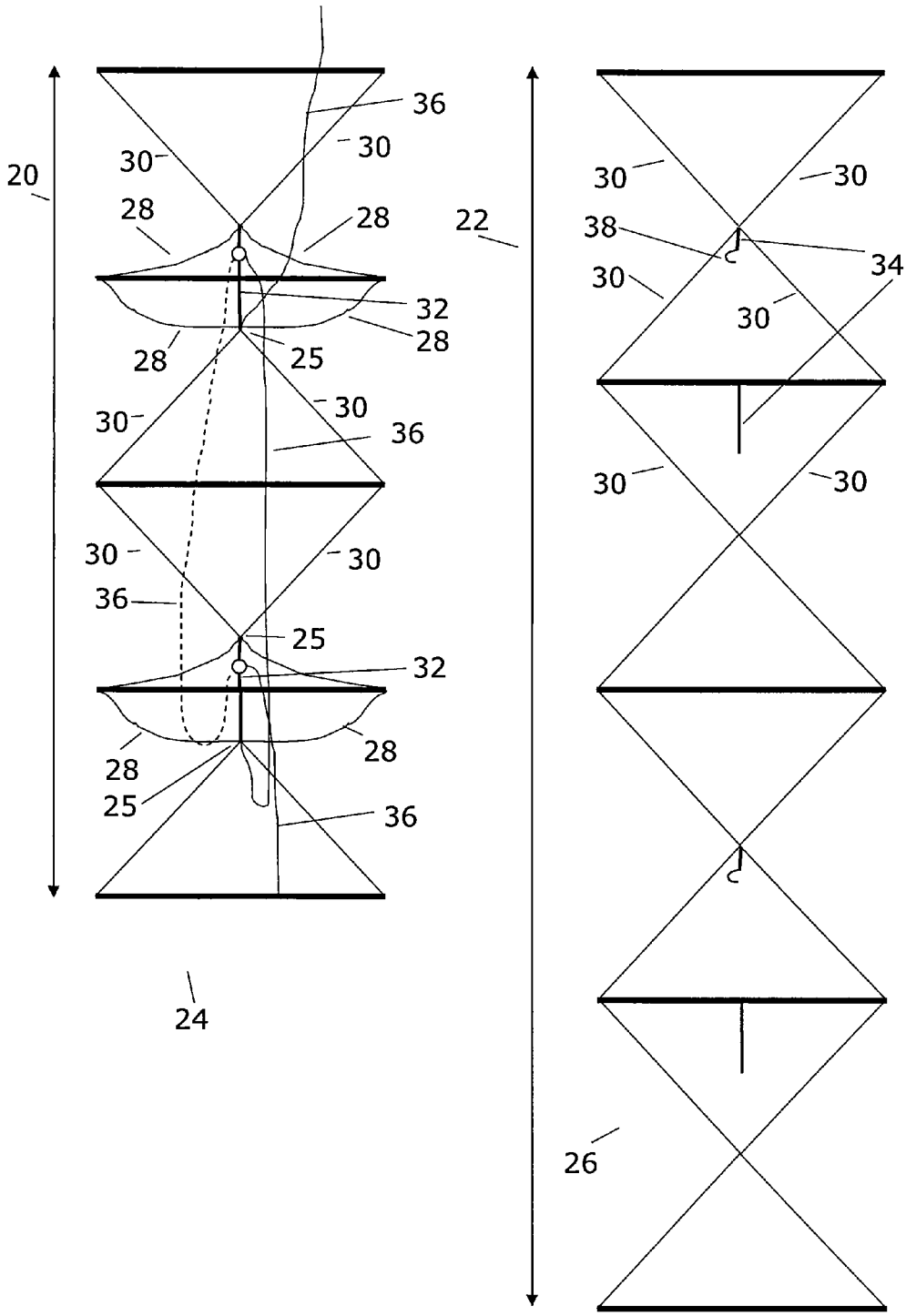

FIG. 7 shows an example in accordance with the invention were a connection between five shaping sections 7 is changed from a first mode of operation 24 to a second mode of operation 26. In particular FIG. 7 shows an example were the substantially non-prolongable connection is engaged 32 in the first mode of operation 24 and disengaged 34 in the second mode of operation 26 between two couplings 25 on both sides of every second successive shaping section 7. The trigger line may be connected as shown with the dashed line 36 or it may be connected as shown with the full line 36 from the slip hook 38 to the coupling 25 three shaping section further down the chute. In general the connection of the trigger line 36 may be changing down the chute and as shown on the figure the trigger line from the lowest slip hook in the chute shown or the part of the chute shown is connected to the lowest shaping section shown. A possible advantage of a trigger line having a length extending over a number of non-limited parts of the chute is that a tolerance in the length of the trigger line becomes relative smaller than if the trigger line e.g. only extends over one non-limited part of the chute.

Figure 8:
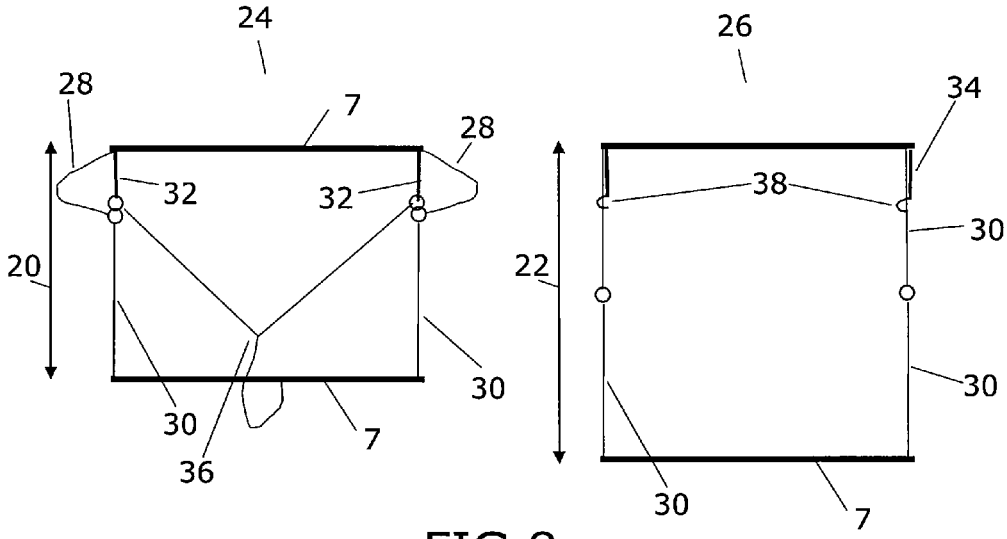

FIG. 8 shows an example in accordance with the invention were a connection between two shaping sections 7 is changed from a first mode of operation 24 to a second mode of operation 26. In this example the elastic cords are provided for prolongation only or primarily in the direction of the longitudinal axis 18 of the chute 2. The parts 28 of the elastic cords are limited from being prolonged by the substantially non-prolongable connection being engaged between the shaping section 7 and a point in an end of the part 30 of the elastic cord.

Figure 9:
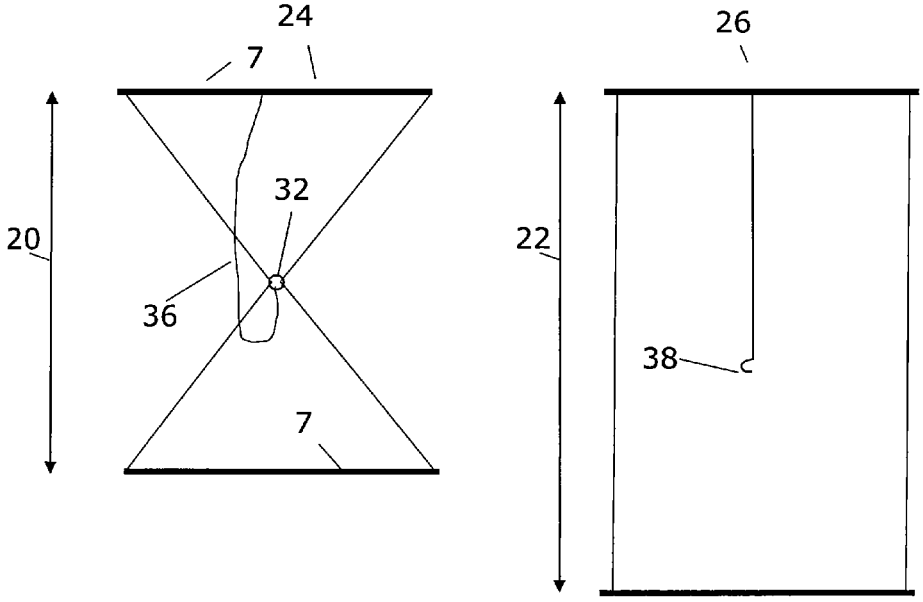
FIG. 9 shows an example of how a number of elastic cords are at least partly limited from substantially extending in a direction of the longitudinal axis in a mode of operation, and a number of elastic cords which are not at least partly limited from substantially extending in a direction of the longitudinal axis in an other mode of operation.

FIG. 9 shows an example in accordance with the invention were a connection between two shaping sections 7 is changed from a mode of operation to another mode of operation, such as from a first mode of operation 24 to a second mode of operation 26. In particular FIG. 9 shows a construction of the chute wherein the connection of the succession of shaping sections includes a number of elastic cords which are at least partly limited from substantially extending in a direction of the longitudinal axis in one mode of operation 24 by engagement of the length limiting means 32, and wherein the connection of the succession of shaping sections includes a number of elastic cords which are not at least partly limited from substantially extending in a direction of the longitudinal axis in the second mode of operation 26 by disengagement of the length engagement/disengagement means 38 as shown in the right side of FIG. 9.

Although the present invention has been described in connection with the specified embodiments, it is not intended to be limited to the specific form set forth herein. Rather, the scope of the present invention is limited only by the accompanying claims. In the claims, the term "comprising" does not exclude the presence of other elements or steps. Additionally, although individual features may be included in different claims, these may possibly be advantageously combined, and the inclusion in different claims does not imply that a combination of features is not feasible and/or advantageous. In addition, singular references do not exclude a plurality. Thus, references to "a", "an", "first", "second" etc. do not preclude a plurality. Furthermore, reference signs in the claims shall not be construed as limiting the scope.

Elsewhere in the application for present invention it is described that the present invention involves an escape system for evacuation, the escape system including a chute comprising a succession of linked and spaced apart shaping sections, the succession including a number of shaping sections being connected by elastic cords and linking successive shaping sections in a direction corresponding to a longitudinal axis of the succession of shaping sections, and at least one tunnel-like device being adapted to enable a person who is being evacuated to move from a first position to a second position through the tunnel-like device, and wherein the chute is arranged to have a self adjusting length and hereby operable at at least two relative different chute lengths when the chute has been launched and the chute is hanging substantially vertically from the higher position to the lower position, and the escape system comprises length limiting means for changing between operation modes between the at least two relative different chute lengths.

The invention claimed is:

1. An escape system for emergency evacuation from a first higher position to a second lower position comprising a chute, said chute comprising:

a plurality of spaced apart shaping sections defining a longitudinal axis, each shaping section including at least one ring-like structure;

a plurality of elastic cords for connecting said plurality of shaping sections, said elastic cords having a cord coupling at an intermediate section thereof, said plurality of elastic cords being connected to the shaping sections in positions along a circumference of the ring-like structures, wherein said plurality of elastic cords are configured to allow relative motion between shaping sections in a direction generally parallel to the longitudinal axis of shaping sections;

at least one tunnel-like device arranged and held inside the plurality of shaping sections and configured to enable a person who is being evacuated to move from the first position to the second position through the tunnel-like device; and a plurality of length limiting means, each length limiting means having one end connected directly to at least one of the ring-like structure and another end having means for releasably connecting directly to the cord coupling, said length limiting means providing the chute with a self adjusting length so as to be operable at least at two different mean chute lengths when the chute has been launched and the chute is hanging substantially vertically from the higher position to the lower position.

2. The escape system according to claim 1, wherein the length limiting means includes an engaged position and a release position, the escape system further comprising:

a first operating mode when the length limiting means is in the engaged position wherein the chute is limited from prolongation beyond a certain distance when the chute has been launched and the chute is hanging substantially vertically from the higher position to the lower position; and a second operating mode when the length limiting means is in the release position wherein the chute is no longer limited from prolongation beyond the certain distance when the chute has been launched and the chute is hanging substantially vertically from the higher position to the lower position.

3. The escape system according to claim 2, wherein when in the first operating mode, the chute has a first mean chute length and when in the second operating mode the chute has a second mean chute length, the escape system further configured to be capable of varying the length of the chute about each of the first and second mean chute lengths.

4. The escape system according to claim 2, wherein when in the first operating mode an obtainable spacing between two or more shaping sections is limited to a first predetermined extent at least in a direction along the longitudinal axis of the shaping sections.

5. The escape system according to claim 3, wherein when in the second operating mode an obtainable spacing between two or more shaping sections has a second predetermined extent at least in a direction along the longitudinal axis of shaping sections which is greater than the first predetermined extent.

6. The escape system according to claim 2, wherein when in the first operating mode, at least a portion of the plurality of elastic cords is at least partly limited from being prolonged, and when in the second operating mode, the portion of the plurality of elastic cords is not at least partly limited from being prolonged.

7. The escape system according to claim 1, wherein when the chute has been launched and the chute is hanging vertically from the higher position to the lower position, at least some of the plurality of elastic cords extend in a direction different from a vertical direction.

8. The escape system according to claim 2, wherein the at least some of the plurality of elastic cords connecting the shaping sections are connected two-by-two to provide the cord coupling between at least two elastic cords.

9. The escape system according to claim 6, wherein the length limiting means comprises a substantially non-prolongable connection between a first part of the escape system and a second part of the escape system, the non-prolongable connection being engaged when in the first operating mode and being disengaged when in the second operating mode, the first part of the escape system being selected from one of the cord coupling and the shaping section and the second part of the escape system being selected from one of the cord coupling and the shaping section.

10. The escape system according to claim 2, wherein when in the first operating mode, at least a portion of the plurality of elastic cords is at least partly limited from substantially extending in a direction along the longitudinal axis, and when in the second operating mode, the portion of the plurality of elastic cords is not at least partly limited from substantially extending in the direction along the longitudinal axis.

11. The escape system according to claim 10, wherein when the chute has been launched and the chute is hanging vertically from the higher position to the lower position, at least some of the plurality of elastic cords extend in a direction different from a vertical direction, and wherein the at least some of the plurality of elastic cords extending in a direction different from the vertical direction are connected two-by-two with a resilient connection, a lashing, or rigid connector to provide the cord coupling between at least two elastic cords, the cord coupling being substantially midway between two adjacent shaping sections when in the first operating mode, and wherein the resilient connection, lashing, or rigid connector is disengaged in the second operating mode.

12. The escape system according to claim 1, wherein the length limiting means comprises one or more substantially non-prolongable lines extending between a first part of the escape system and a second part of the escape system to limit the chute length, the one or more non-prolongable lines being disengageable to change the chute length.

13. The escape system according to claim 1, wherein the length limiting means comprises disengagement means for disengaging the length limiting means.

14. The escape system according to claim 13, wherein the disengagement means is configured to disengage when subjected to a certain strain.

15. The escape system according to claim 1, wherein the length limiting means is configured to have an engaged position and a release position, the chute having a first mean length when the length limiting means is in the engaged position and a second mean length greater than the first mean length when the length limiting means is in the release position, wherein when in the engaged position at least one of the plurality of elastic cords has a portion that is prevented from being prolonged and when in the release position the portion is no longer prevented from being prolonged.

16. An escape system for emergency evacuation from a first higher position to a second lower position comprising a chute, said chute comprising:

a plurality of spaced apart shaping sections defining a longitudinal axis, each shaping section including at least one ring-like structure;

a plurality of elastic cords for connecting said plurality of shaping sections, said plurality of elastic cords being connected to the shaping sections in positions along a circumference of the ring-like structures, wherein said plurality of elastic cords are configured to allow relative motion between shaping sections in a direction generally parallel to the longitudinal axis of the shaping sections;

at least one tunnel-like device arranged and held inside the plurality of shaping sections and configured to enable a person who is being evacuated to move from the first position to the second position through the tunnel-like device; and a length limiting means, said length limiting means providing the chute with a self adjusting length so as to be operable at least at two different chute lengths when the chute has been launched and the chute is hanging substantially vertically from the higher position to the lower position, wherein the length limiting means comprises one or more substantially non-prolongable lines extending between a first part of the escape system and a second part of the escape system to limit the chute length, the one or more non-prolongable lines being disengageable to change the chute length, and wherein the length limiting means further comprises one or more substantially non-prolongable trigger lines to trigger disengagement of the one or more substantially non-prolongable lines that form the length limiting means.

17. The escape system according to claim 16, wherein the one or more substantially non-prolongable trigger lines are connected between a disengagement means of the length limiting means and one or more of the following attachment places: a cord coupling, a fixed position at the first higher position, a shaping section, and another disengagement means.

18. The escape system according to claim 16, wherein the one or more substantially non-prolongable trigger lines have a length which is a predetermined maximum length of spacing between two parts of the chute, the disengagement means bewing triggered when the maximum length of the spacing is reached.

19. An escape system for emergency evacuation from a first higher position to a second lower position comprising a chute, said chute comprising:

a first shaping section and a second shaping section spaced from the first shaping section and defining a longitudinal axis, each shaping section including at least one ring-like structure;

a plurality of elastic cords extending from the first shaping section to the second shaping section and coupling to their respective ring-like structures, said elastic cords having a cord coupling at an intermediate section thereof, wherein said plurality of elastic cords are configured to allow relative motion between the first and second shaping sections in a direction generally parallel to the longitudinal axis; and at least one tunnel-like device arranged and held inside the first and second shaping sections and configured to enable a person who is being evacuated to move from the first position to the second position through the tunnel-like device; and a length limiting means having one end connected directly to at least one of the ring-like structure and another end having means for releasably connecting directly to the cord coupling, the length limiting means further having an engaged position and a release position for selectively limiting the length of at least one of said plurality of elastic cords, wherein when the length limiting means is in the engaged position, the at least one elastic cord includes a first part capable of prolonging and a second part prevented from prolonging such that the chute has a first mean length when the chute has been launched and the chute is hanging substantially vertically from the higher position to the lower position, and when the length limiting means is in the release position, the second part is no longer prevented from prolonging and the chute has a second mean length greater than the first mean length when the chute has been launched and the chute is hanging substantially vertically from the higher position to the lower position.

* * * * *